US008013824B2

(12) United States Patent
Chu et al.

(10) Patent No.: US 8,013,824 B2
(45) Date of Patent: Sep. 6, 2011

(54) SEQUENCE CONTROL UNIT, DRIVING METHOD THEREOF, AND LIQUID CRYSTAL DISPLAY DEVICE HAVING THE SAME

(75) Inventors: Hong Sig Chu, Cheonan-si (KR); Jae Min Ha, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 787 days.

(21) Appl. No.: 11/858,428

(22) Filed: Sep. 20, 2007

(65) Prior Publication Data

US 2008/0074375 A1 Mar. 27, 2008

(30) Foreign Application Priority Data

Sep. 21, 2006 (KR) ..... 10-2006-0091554

(51) Int. Cl.
*G09G 3/36* (2006.01)

(52) U.S. Cl. ..... 345/90; 345/98

(58) Field of Classification Search ..... 345/90, 345/87, 94, 98, 99, 100
See application file for complete search history.

(56) References Cited

U.S. PATENT DOCUMENTS

| | | | | |
|---|---|---|---|---|
| 5,777,596 | A * | 7/1998 | Herbert | 345/104 |
| 6,577,071 | B2 * | 6/2003 | Matsumoto | 315/169.4 |
| 7,015,904 | B2 * | 3/2006 | Kim | 345/212 |
| 7,015,905 | B2 * | 3/2006 | Onozawa et al. | 345/212 |
| 7,142,186 | B2 * | 11/2006 | Lee et al. | 345/89 |
| 7,148,866 | B2 * | 12/2006 | Jun | 345/87 |
| 7,518,588 | B2 * | 4/2009 | Lin | 345/98 |
| 7,830,450 | B2 * | 11/2010 | Gong et al. | 348/459 |
| 2003/0098833 | A1 * | 5/2003 | Sekido et al. | 345/87 |
| 2005/0219176 | A1 * | 10/2005 | Song | 345/87 |
| 2006/0092120 | A1 * | 5/2006 | Nose | 345/98 |
| 2008/0062185 | A1 * | 3/2008 | Gong et al. | 345/545 |

FOREIGN PATENT DOCUMENTS

| | | |
|---|---|---|
| JP | 2001-100175 | 4/2001 |
| KR | 1020040052356 | 6/2004 |
| KR | 1020050062119 | 6/2005 |

* cited by examiner

*Primary Examiner* — Richard Hjerpe
*Assistant Examiner* — Jeffrey Parker
(74) *Attorney, Agent, or Firm* — H.C. Park & Associates, PLC

(57) ABSTRACT

A sequence control unit includes a voltage input/output unit to receive a driving voltage, and to output the driving voltage after a delay time. A memory stores an output time corresponding to the driving voltage, a clock generating unit generates a clock, a clock counter counts the clock in response to a counting signal, and a sequence controller supplies the counting signal corresponding to the output timing to the clock counter from the memory. The sequence controller receives the number of clock cycles or time associated with the number of clock cycles counted by the clock counter as clock counting information, and controls the delay time output of the driving voltage according to the clock counting information. A driving method for driving the sequence control unit is disclosed, and the sequence control unit may be included in a liquid crystal display device.

7 Claims, 4 Drawing Sheets

SEQUENCE CONTROL UNIT, DRIVING METHOD THEREOF, AND LIQUID CRYSTAL DISPLAY DEVICE HAVING THE SAME

CROSS REFERENCE TO RELATED APPLICATION

This application claims priority from and the benefit of Korean Patent Application No. 10-2006-0091554, filed on Sep. 21, 2006, which is hereby incorporated by reference for all purposes as if fully set forth herein.

BACKGROUND OF THE INVENTION

1. Field of the Invention

The present invention relates to a sequence control unit, a driving method thereof, and a liquid crystal display device having the same. The present invention is suitable for a wide scope of applications, including outputting a voltage with a delay time after the voltage is input.

2. Discussion of the Background

Generally, a liquid crystal display ("LCD") device includes an LCD panel for displaying an image, a driving circuit unit for driving the LCD panel, and a backlight unit for generating light to display an image on the LCD panel.

The LCD panel includes a thin film transistor ("TFT") substrate, a color filter substrate opposing the TFT substrate, and liquid crystals interposed between the TFT substrate and the color filter substrate. The LCD panel displays an image by adjusting light transmissivity through the liquid crystals in response to a potential difference between a pixel electrode arranged on the TFT substrate and a common electrode arranged on the color filter substrate.

A panel driving unit includes a gate driving unit for driving a gate line included in the LCD panel, a data driving unit for driving a data line included in the LCD panel, a timing controller for supplying a gate control signal to the gate driving unit and a data control signal to the data driving unit, and a direct current/direct current converter ("DC/DC converter") for supplying driving voltages to the data driving unit and the common electrode. In this case, the driving voltages supplied from the DC/DC converter may be output to the corresponding data driving unit or the common electrode with a predetermined time delay or in a preset sequence. The LCD device conventionally uses a resistance-capacitance ("RC") delay circuit to control the time delay of the driving voltages supplied to the corresponding driving units.

FIG. 1A is a diagram of an RC delay circuit of an LCD device according to the prior art. FIG. 1B is a diagram illustrating sequence control using an RC delay circuit of an LCD device according to the prior art.

Referring to FIG. 1A, a conventional LCD device uses an RC delay circuit having a resistor R connected in parallel with a capacitor C to control a sequence of driving voltages Vin. A second terminal of the capacitor C is connected to ground.

The RC delay circuit delays the output of an output voltage Vout after the input of a driving voltage Vin according to an RC value. In this case, a waveform of the input driving voltage Vin via the RC delay circuit, as shown in FIG. 1B, is delayed by a delay time T1. The input driving voltage Vin passing through the RC delay circuit reaches a threshold voltage Vth along a smooth curve and then reaches a turn-on voltage Vton. If the delay time T1 is measured from the input driving voltage Vin to the threshold voltage Vth, the delay time T1 may vary according to values of the resistor R and capacitor C of the RC delay circuit.

In the LCD device, the actual delay time may vary according to lengths of signal lines supplied to the respective driving units and a delay caused by a parasitic capacitance between adjacent signal lines. Thus, the delay time T1 taken for the input driving voltage Vin to reach the threshold voltage Vth may vary according to environmental conditions of the LCD device. If the delay time T1 of the RC delay circuit increases, a rising time of the input driving voltage Vin increases. Accordingly, a signal-to-noise ratio ("SNR") at the data driving unit receiving the corresponding driving voltage may decrease. If the SNR decreases, the data driving unit may have difficulty recognizing the corresponding driving voltage, thereby generating an error. Moreover, if the delay time T1 of the input driving voltage Vin increases, it may be difficult to match the timings of the driving voltages Vin actually outputted from the respective driving units of the LCD device. So, a driving failure of the LCD device may occur.

SUMMARY OF THE INVENTION

This invention provides a sequence control unit, a driving method thereof, and a liquid crystal display device having the same, where a voltage is output with a delay time after the voltage is input.

Additional features of the invention will be set forth in the description which follows, and in part will be apparent from the description, or may be learned by practice of the invention.

The present invention discloses a sequence control unit including a voltage input/output unit to receive a voltage and to output the voltage, a memory to store an output timing of the voltage, a clock generating unit to generate a clock, a clock counter to count the clock in response to a counting signal, and to generate clock counting information, and a sequence controller to supply the counting signal to the clock counter, and to control the output of the voltage from the voltage input/output unit when the clock counting information corresponds to the output timing.

The present invention also discloses a method for driving a sequence control unit including storing output timing information corresponding to a driving voltage inputted to a voltage input/output unit, counting a clock, generating clock counting information, and outputting the voltage when the clock counting information corresponds to the output timing information.

The present invention also discloses a liquid crystal display device including a liquid crystal display panel to display an image, a panel driving unit to drive the liquid crystal display panel, a timing controller to transmit a pixel data signal to the panel driving unit and to generate a control signal, a direct current/direct current ("DC/DC") converter to generate driving voltages, and a sequence control unit. The sequence control unit includes a voltage input/output unit to receive the driving voltages and to output the driving voltages, a memory to store an output timing of the driving voltages, a clock generating unit to generate a clock, a clock counter to count the clock in response to a counting signal, and to generate clock counting information, and a sequence controller to supply the counting signal to the clock counter from the memory, and to control the output of the driving voltages from the voltage input/output unit when the clock counting information corresponds to the output timing.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principles of the invention.

DETAILED DESCRIPTION OF THE ILLUSTRATED EMBODIMENTS

Figure 1A:
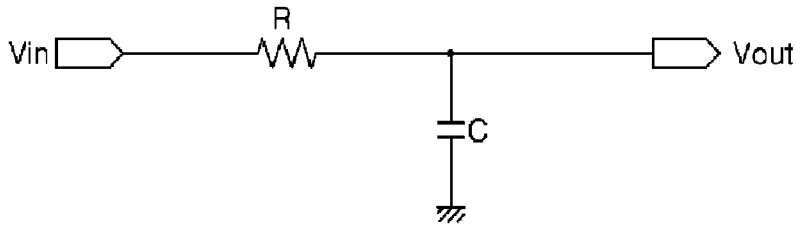
FIG. 1A (PRIOR ART)
FIG. 1A is a diagram of an RC delay circuit of an LCD device according to the prior art.
Figure 1B:
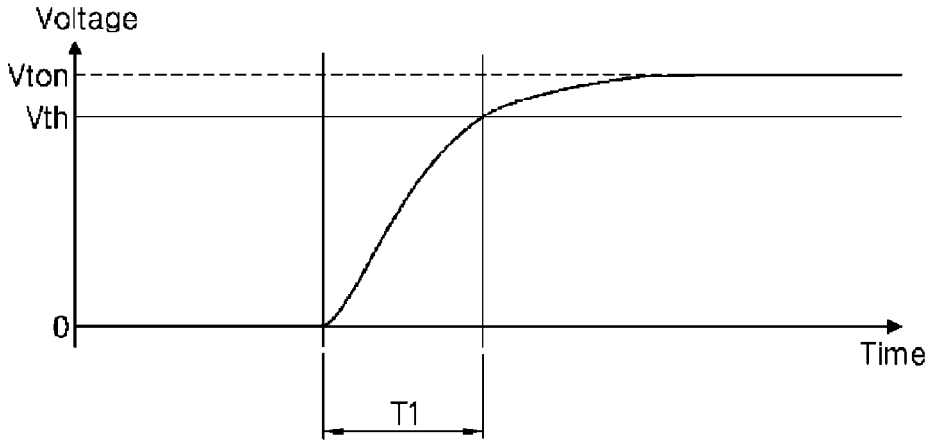
FIG. 1B (PRIOR ART)
FIG. 1B is a diagram illustrating sequence control using an RC delay circuit of an LCD device according to the prior art.

The invention is described more fully hereinafter with reference to the accompanying drawings, in which embodiments of the invention are shown. This invention may, however, be embodied in many different forms and should not be construed as limited to the embodiments set forth herein. Rather these embodiments are provided so that this disclosure is thorough, and will fully convey the scope of the invention to those skilled in the art. In the drawings, the size and relative size of layers and regions may be exaggerated for clarity. Like reference numerals in the drawings denote like elements.

It will be understood that when an element such as a layer, film, region or substrate is referred to as being "on", "connected to", or "coupled to" another element or layer, it can be directly on, directly connected to, or directly coupled to the other element or layer, or intervening elements or layers may also be present. In contrast, when an element is referred to as being "directly on", "directly connected to", or "directly coupled to" another element or layer, there are not intervening elements or layers present.

Figure 2:
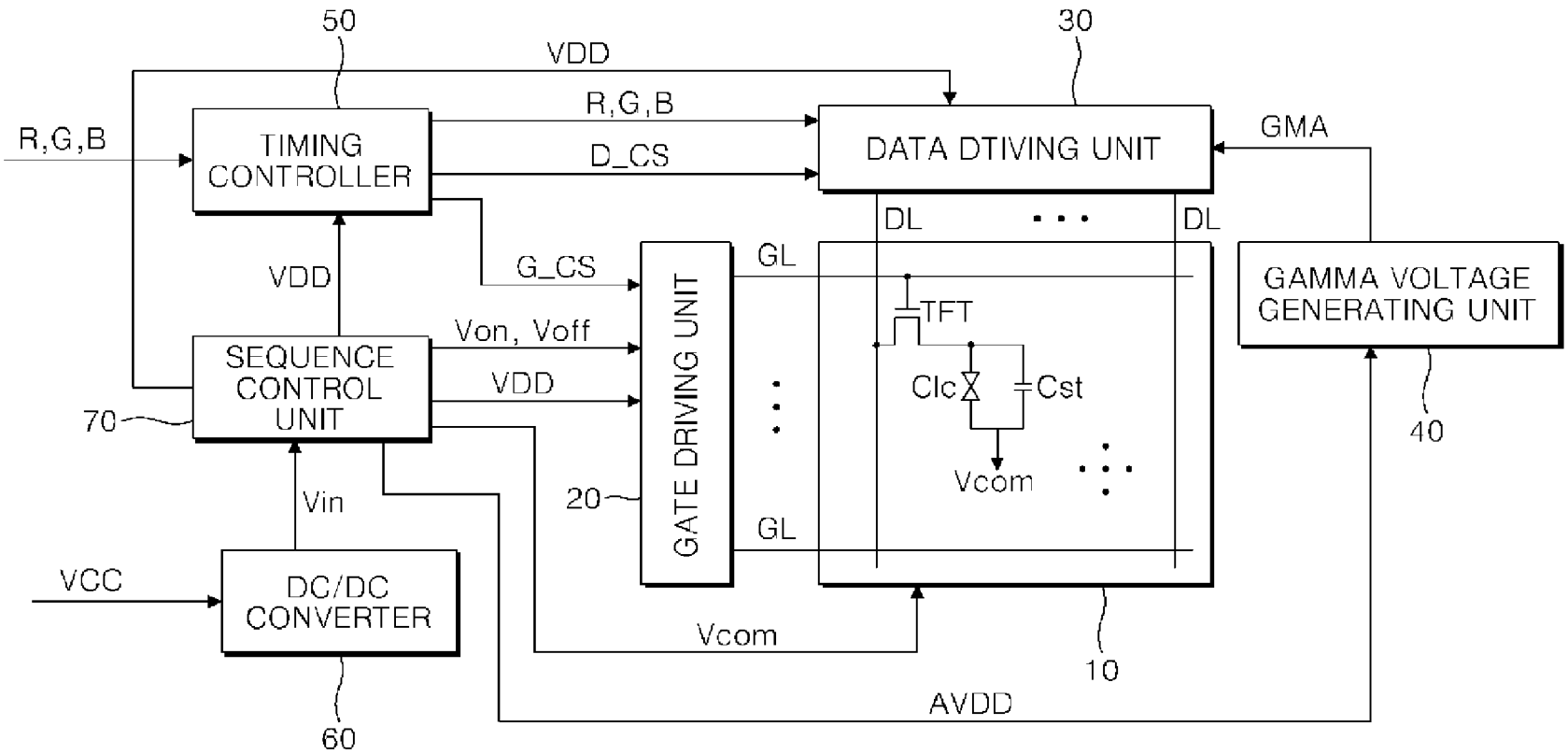
FIG. 2 is a block diagram of an LCD device having a sequence control unit according to an exemplary embodiment of the present invention.

FIG. 2 is a block diagram of an LCD device having a sequence control unit according to an exemplary embodiment of the present invention.

Referring to FIG. 2, an LCD device according to an exemplary embodiment of the present invention includes an LCD panel 10, a gate driving unit 20, a data driving unit 30, a gamma voltage generating unit 40, a sequence control unit 70, a timing controller 50, and a DC/DC converter 60.

The LCD panel 10 includes a thin film transistor ("TFT") substrate, a color filter substrate opposing the TFT substrate, and liquid crystals interposed between the TFT substrate and the color filter substrate to adjust light transmissivity.

The TFT substrate includes gate lines GL and data lines DL insulated from and arranged to cross with each other, TFTs arranged at intersections between and each connected to a gate line GL and a data line DL, pixel electrodes connected to each TFT, and storage electrodes for sustaining voltages charged in the pixel electrodes.

The color filter substrate includes a black matrix overlapping with the gate lines GL, the data lines DL, and the TFTs to prevent light leakage, color filters overlapping with pixel areas corresponding to the pixel electrodes and partitioned by the black matrix, and a common electrode arranged on the color filter to receive a common voltage Vcom.

The liquid crystals are arranged between the TFT substrate and the color filter substrate to display a gray scale by changing alignment in response to an electric field generated between the pixel electrode and the common electrode.

The LCD panel 10 displays an image by applying a pixel data voltage to the pixel electrode to generate an electric field between the pixel electrode and the common electrode. The transmissivity of light through the liquid crystals corresponds to the liquid crystal alignment in response to the generated electric field. A liquid crystal capacitor Clc is formed by the liquid crystals arranged between the pixel electrode and the common electrode. A storage capacitor Cst is formed by the overlap between the storage electrode and the pixel electrode.

The timing controller 50 supplies pixel data signals R, G, B inputted from an external source to the data driving unit 30 and supplies control signals to the gate driving unit 20 and the data driving unit 30. More specifically, the timing controller 50 supplies red (R), green (G), and blue (B) pixel data signals R, G, B to the data driving unit 30 according to an inputted horizontal synchronizing signal. The timing controller 50 generates a data control signal D_CS, which may be a data start pulse or a data shift clock, and supplies the data control signal D_CS to the data driving unit 30. Moreover, the timing controller 50 generates a gate control signal G_CS, which may be a gate start pulse or a gate shift clock, and supplies the gate control signal G_CS to the gate driving unit 20.

The gamma voltage generating unit 40 generates gamma voltages GMA with reference to an analog voltage AVDD, which is generated by and provided from the sequence control unit 70. The gamma voltage generating unit 40 supplies the gamma voltages GMA to the data driving unit 30. The gamma voltage generating unit 40 includes resistors connected in series (not shown) between a ground voltage source and an analog voltage AVDD source, and includes output terminals connected between the serially connected resistors. The gamma voltage generating unit 40 generates and outputs gamma voltages GMA as distributed voltages corresponding to the serially connected resistors.

The gate driving unit 20, which is connected to the gate lines GL, sequentially supplies a gate-on voltage Von to one gate line GL and a gate-off voltage Voff to the rest of the gate lines GL. The gate driving unit 20 may be an Integrated Circuit ("IC") and may be a chip-on-glass ("COG") type arranged on the TFT substrate, or a Tape Carrier Package ("TCP") type.

The data driving unit 30 is connected to the data lines DL. Upon receipt of the pixel data signals R, G, B and the data control signal D_CS from the timing controller 50, the data driving unit 30 converts the received pixel data signals R, G, B into analog pixel data signals by using the gamma voltage GMA supplied by the gamma voltage generating unit 40. The data driving unit 30 supplies the converted analog pixel data signals to the data lines DL. The data driving unit 30 may be an IC and may be a COG arranged on the TFT substrate or a TCP.

The DC/DC converter 60 receives a reference voltage VCC from an external source and generates driving voltages Vin. The driving voltages Vin may include a gate-on voltage Von, a gate-off voltage Voff, a common voltage Vcom, and an analog voltage AVDD. The DC/DC converter 60 supplies the driving voltages Vin to the sequence control unit 70. More specifically, the DC/DC converter 60 generates the gate-on voltage Von and the gate-off voltage Voff supplied to the gate lines GL, the analog voltage AVDD supplied to the gamma voltage generating unit 40, and the common voltage Vcom supplied to the LCD panel 10. The DC/DC converter 60 supplies the reference voltage VCC to the timing controller 50. The DC/DC converter 60 also generates an initial driving voltage VDD for driving the driving ICs, including the driving ICs of the timing controller 50, the gate driving unit 20, and the data driving unit 30.

As mentioned in the foregoing description, the driving voltages Vin generated by the DC/DC converter 60 are supplied to the sequence control unit 70 to adjust the output timings.

The sequence control unit 70 delays the output of input voltages Vin supplied from the DC/DC converter 60 to be suitable for a corresponding sequence. This will be explained in detail below.

The sequence control unit 70 according to an exemplary embodiment of the present invention is explained in detail with reference to FIG. 3 as follows.

Figure 3:
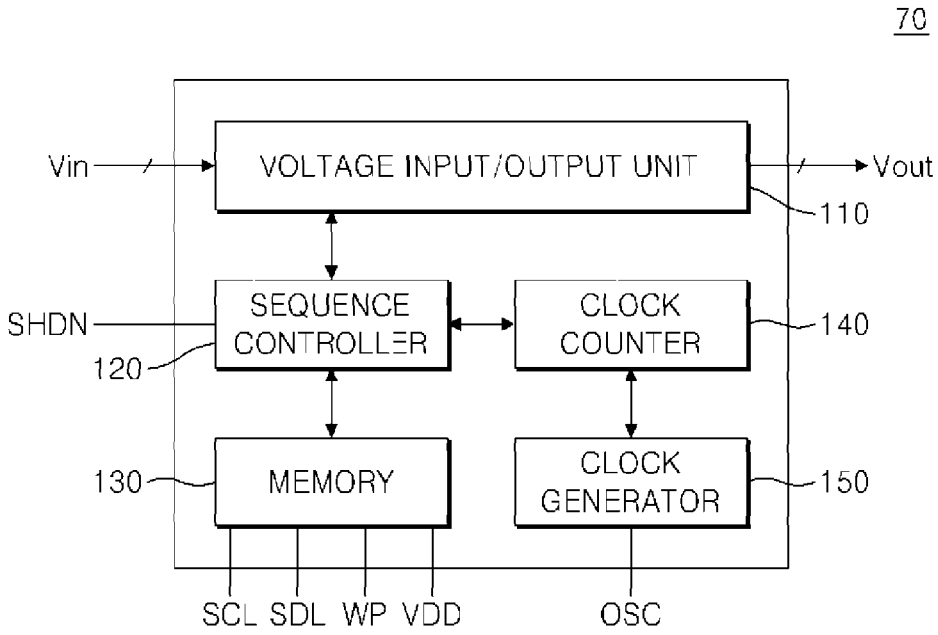
FIG. 3 is a block diagram of the sequence control unit shown in FIG. 2.

FIG. 3 is a block diagram of the sequence control unit 70 shown in FIG. 2.

Referring to FIG. 3, the sequence control unit 70 includes a voltage input/output unit 110, a memory 130, a clock generator 150, a clock counter 140, and a sequence controller 120.

The driving voltages Vin are inputted to the voltage input/output unit 110 from the DC/DC converter 60, and the voltage input/output unit 110 then outputs the inputted driving voltages Vin after a delay time as output voltages Vout. The voltage input/output unit 110 includes voltage input terminals for receiving the inputted driving voltages Vin and includes output terminals for outputting output voltages Vout after a delay time.

The memory 130 may be a storage medium such as an electrically erasable programmable read-only memory (EEPROM). The memory 130 may store output timings of driving voltages Vin to be inputted to the voltage input/output unit 110 as digital signals. More specifically, the memory 130 may store output timing data signals corresponding to the input driving voltages Vin, and the output timing data signals may be retrieved or provided by serial communications to the sequence controller 120 in response to a request from the sequence controller 120. In particular, a serial clock signal SCL and a serial data signal SDL may be input to the memory 130 by Inter-Integrated Circuit ("I2C") serial communications. The output timing data signal inputted to the memory 130 as the serial data signal SDL is stored at an address assigned to the memory 130 according to the serial clock signal SCL. The output timing data signal inputted to the address of the memory 130 may be prevented from being erased using a write preventing signal WP. However, the output timing data signal stored in the memory 130 may be erased.

The clock generator 150 generates a clock having a predetermined period. The clock generator 150 supplies the clock to the clock counter 140. In this case, the period of the clock generated by the clock generator 150 may be equal to or shorter than a delay time of a driving voltage Vout having a minimum delay time from among the input driving voltages Vin. In particular, since the sequence control unit 70 delays the output of the inputted driving voltages Vin, it may be more difficult to calculate a delay time if the period of the clock generated by the clock generator 150 is greater than the minimum delay time. So, the period of the clock generated by the clock generator 150 may be shorter than the minimum delay time, such as 1/N times a minimum delay time for delaying the output of the input voltage Vin in the sequence control unit 70, where N is less than 1 but greater than 0.

The clock counter 140 counts cycles of a clock inputted from the clock generator 150 and then supplies a total time of the added clock cycles or the number of the clock cycles to the sequence controller 120. If an output timing data signal corresponding to a driving voltage Vin inputted to the voltage input/output unit 110 is supplied to the sequence controller 120, the sequence controller 120 supplies the output timing data signal to the clock counter 140, and the clock counter 140 supplies a total time of the added clock cycles or the number of the clock cycles to the sequence controller 120 resulting from counting the clock inputted from the clock generator 150.

The sequence controller 120 reads the output timing data signal from the memory 130 for the delay time of the driving voltage Vin inputted to the voltage input/output unit 110. The sequence controller 120 supplies a clock counting command signal to the clock counter 140 corresponding to the output timing data signal read from the memory 130 and delays the output of the driving voltage Vin inputted to the voltage input/output unit 110 by the time of the added clock cycles counted by the clock counter 140.

Additionally, the sequence controller 120 turns off power to the sequence control unit 70 if power to the LCD device is turned off. For this, the sequence controller 120 includes a shut-down terminal (not shown) to receive a shut-down signal SHDN for shutting down the sequence control unit 70. If the shut-down signal SHDN is inputted to the shut-down terminal from an external system, an output of the voltage input/output unit 110 of the sequence control unit 70 is cut off.

Figure 4:
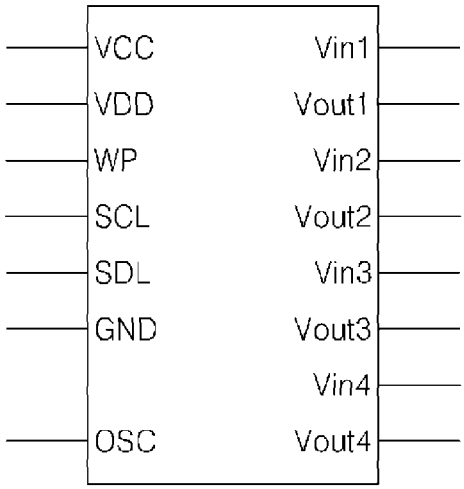
FIG. 4 is a diagram showing an exemplary embodiment of a sequence control unit as an integrated circuit.

FIG. 4 is a diagram showing an exemplary embodiment of a sequence control unit as an integrated circuit.

The sequence control unit 70 may be an IC. In this case, the sequence control unit 70, as shown in FIG. 4, includes terminals to which input voltages Vin1, Vin2, Vin3, and Vin4, output voltages Vout1, Vout2, Vout3, and Vout4, a serial clock signal SCL, a serial data signal SDL, a clock signal OSC, a driving voltage VDD, a reference voltage VCC, a write preventing signal WP, and a ground voltage GND are input/output.

Thus, the sequence control unit 70 IC may be arranged on a circuit board (not shown) or the TFT substrate of the LCD panel 10.

By digitally controlling the sequence of the voltages supplied to the LCD device using the above-configured sequence control unit 70, the present invention may control the supply timing of the driving voltages Vin more precisely than controlling the sequence using an RC circuit. Hence, the sequence control unit 70 may prevent malfunctions or errors of the respective driving devices, such as the timing controller 50, the gate driving unit 20, the data driving unit 30, and the gamma voltage generating unit 40.

A method for driving the sequence control unit is explained in detail with reference to FIG. 5.

Figure 5:
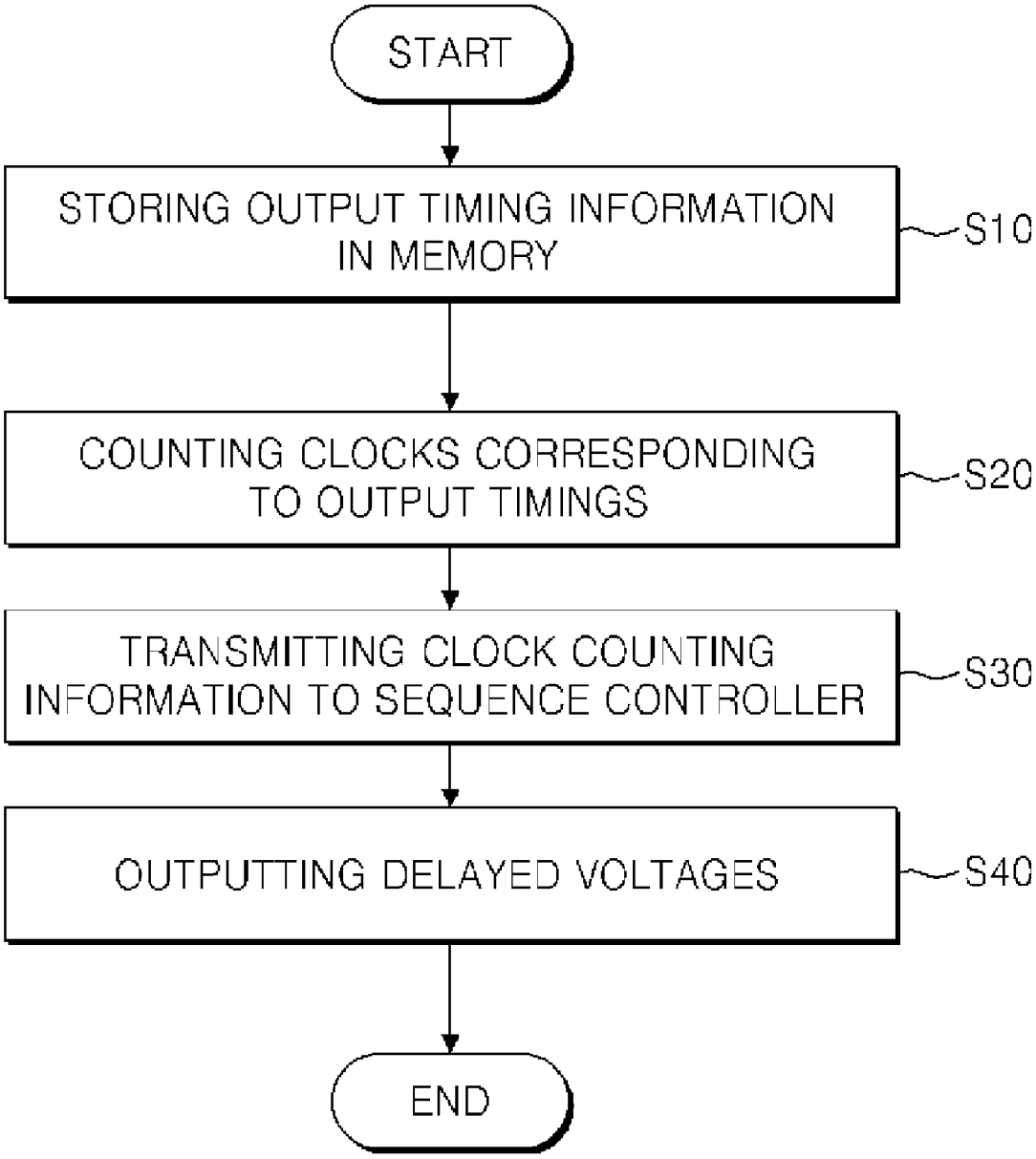
FIG. 5 illustrates a method for driving a sequence control unit shown according to an exemplary embodiment of the present invention.

FIG. 5 illustrates a method for driving a sequence control unit according to an exemplary embodiment of the present invention. The following description is explained with reference to FIG. 2, FIG. 3, and FIG. 4.

Referring to FIG. 5, a method for driving the sequence control unit includes storing output timing information in the memory 130 (step S11), counting a clock corresponding to output timings (step S20), transmitting clock counting information to the sequence controller 120 (step S30), and outputting delayed voltages (step S40).

More specifically, in step S10, the output timing data signals of the input driving voltages Vin are stored in the memory 130 using I2C serial communications with the timing controller 50 or an external controller. In this case, the serial data signal SDL including an output timing data signal is stored at an address in the memory 130 in synchronization with the serial clock signal SCL inputted through an I2C serial communication port. The output timing data signals stored in the memory 130 may be stored as information corresponding to a number of clock cycles to be added or counted by the clock counter 140.

In step S20, if the driving voltages Vin, which may include the gate-on voltage Von, the gate-off voltage Voff, the common voltage Vcom, the reference voltage VCC, and the analog voltage AVDD, are inputted to the voltage input/output unit 110 of the sequence control unit 70 from the DC/DC converter 60, the sequence controller 120 retrieves the output timing data signals corresponding to the input driving voltages Vin from the memory 130, and supplies a clock counting command signal to the clock counter 140 corresponding to the output timing data signal retrieved from the memory 130. In this case, information about types of the input driving voltages Vin is also transmitted to the clock counter 140. The clock counter 140 then counts or adds the clock cycles from the clock counter 140 according to the clock counting command signal corresponding to output timings of the inputted driving voltages Vin.

In step S30, clock counting information, including the number of the clock cycles added by the clock counter 140 or a total time of the added clock cycles, is transmitted to the sequence controller 120. In this case, a total time of the added clock cycles equals M times a clock period where M is a natural number equal to a number of clock cycles.

In step S40, the sequence controller 120 delays the output of the input driving voltage Vin, and controls the output of output voltages Vout from the voltage input/output unit 110 according to the clock counting information.

For instance, if the reference voltage VCC is the driving voltage Vin inputted to the sequence control unit 70, its output may be delayed by about 0.5 ms to about 10 ms according to output timings stored in the memory 130, and corresponding to the output timing data signal read from the memory 130 by the sequence controller 120. The sequence controller 120 retrieves the output timing data signal corresponding to the reference voltage VCC from the memory 130, and transmits the clock counting command signal corresponding to the output timing data signal to the clock counter 140. The clock counter 140 then adds the clock cycles from the clock generator 150. The number of the clock cycles added by the clock counter 140 or a total time of the added clock cycles is transmitted to the sequence controller 120. The sequence controller 120 controls the output of reference voltage VCC as output voltage Vout from the voltage input/output unit 110 according to the clock counting information and the output timing data signal.

A voltage following the reference voltage VCC may have a delay time greater than that of the reference voltage VCC. Namely, the sequence control unit 70 may delay the output of the initial driving voltage VDD for driving the gate driving unit 20 and the data driving unit 30 longer than the delay of the reference voltage VCC. Thereafter, the gate-off voltage Voff, the analog driving voltage AVDD, and the gate-on voltage Von may be sequentially output from the sequence control unit 70.

Accordingly, exemplary embodiments of the present invention provide the following advantages.

First, a sequence of driving voltages may be digitally controlled, thereby reducing malfunctions of the ICs, including the timing controller, the gate driving unit, the data driving unit, and the gamma voltage generating unit. Hence, image quality of an LCD device may be enhanced.

Second, power consumption may be reduced because an RC delay circuit is not included.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display device, comprising: a liquid crystal display panel to display an image;

a panel driving unit configured to drive the liquid crystal display panel in response to panel driving voltages and a control signal;

a timing controller configured to transmit a pixel data signal to the panel driving unit and to generate a control signal in response to a reference voltage;

a direct current/direct current ("DC/DC") converter configured to generate the panel driving voltages and the reference voltage; and a sequence control unit comprising:

a voltage input/output unit configured to receive the panel driving voltages and the reference voltage from the direct current/direct current converter and to output the panel driving voltages and the reference voltage;

a memory configured to store output timing data signals of the panel driving voltages and the reference voltage;

a clock generating unit configured to generate a clock;

a clock counter configured to count the clock in response to a counting signal, and configured to generate clock counting information; and a sequence controller configured to receive the output timing data signals of the panel driving voltages and the reference voltage from the memory, to supply the counting signal to the clock counter according to the output timing data signal of each of the panel driving voltages and the reference voltage, to control the voltage input/output unit in response to the clock counting information to delay the output of each of the panel driving voltages and the reference voltage.

2. The liquid crystal display device of claim 1, wherein the panel driving unit comprises a gate driving unit to drive a gate line of the liquid crystal display panel, a data driving unit to drive a data line of the liquid crystal display panel, and a gamma voltage generating unit to supply a gamma voltage to the data driving unit, and wherein the panel driving voltages comprise a gate-on voltage and a gate-off voltage to be supplied to the panel driving unit, an initial driving voltage to be supplied to the gate driving unit and the data driving unit, an analog voltage to be supplied to the gamma voltage generating unit, and a common voltage to be supplied to the liquid crystal display panel.

3. The liquid crystal display device of claim 1, wherein a serial clock signal and a serial data signal are transmitted to the memory by serial communications.

4. The liquid crystal display device of claim 3, wherein the memory serially communicates with the timing controller or an external system.

5. The liquid crystal display device of claim 1, wherein an output of the sequence control unit is cut off in response to a shut-down signal supplied to the sequence controller.

6. The liquid crystal display device of claim 1, wherein the clock counting information comprises a number of clock cycles counted by the clock counter or a total time of the clock cycles added by the clock counter.

7. The liquid crystal display device of claim 6, wherein the sequence controller delays the output of each of the panel driving voltages and the reference voltage for the clock counting information corresponding to the output timing data signal of each of the panel driving voltages and the reference voltage.

* * * * *